US008293666B2

(12) United States Patent
Heiler et al.

(10) Patent No.: US 8,293,666 B2
(45) Date of Patent: Oct. 23, 2012

(54) BONDED STRUCTURE FOR USE IN GARMENTS

(75) Inventors: Frank Heiler, Weinheim (DE); Matthias Ley, Weinheim (DE); Peter Grynaeus, Birkenau (DE); Steffen Kremser, Heddesheim (DE)

(73) Assignee: Carl Freudenberg KG, Weinheim (DE)

( * ) Notice: Subject to any disclaimer, the term of this patent is extended or adjusted under 35 U.S.C. 154(b) by 10 days.

(21) Appl. No.: 12/598,118

(22) PCT Filed: Mar. 28, 2008

(86) PCT No.: PCT/EP2008/002444
§ 371 (c)(1),
(2), (4) Date: Oct. 29, 2009

(87) PCT Pub. No.: WO2008/151684
PCT Pub. Date: Dec. 18, 2008

(65) Prior Publication Data

US 2010/0129619 A1 May 27, 2010

(30) Foreign Application Priority Data

Jun. 15, 2007 (DE) ..... 10 2007 028 263

(51) Int. Cl.

| | |
|---|---|
| ***B32B 5/26*** | (2006.01) |
| ***B32B 1/00*** | (2006.01) |
| ***B32B 5/02*** | (2006.01) |
| ***D03D 15/00*** | (2006.01) |
| ***D03D 13/00*** | (2006.01) |
| ***A41D 27/02*** | (2006.01) |
| ***A41D 27/06*** | (2006.01) |

(52) U.S. Cl. ..... 442/239; 442/246; 442/247; 442/203; 442/181; 428/196; 2/97; 2/272

(58) Field of Classification Search ..... 442/181–300; 2/97, 164, 272; 428/195.1–205
See application file for complete search history.

(56) References Cited

U.S. PATENT DOCUMENTS 2,184,772 A * 12/1939 Vamos ..... 442/183
(Continued)

FOREIGN PATENT DOCUMENTS

BE 706118 3/1968
(Continued)

OTHER PUBLICATIONS

Humphries, Mary "Fabric Reference" pp. 105-110, copyright 1996 copyright 1996.*

(Continued)

*Primary Examiner* — Jennifer A Steele
(74) *Attorney, Agent, or Firm* — Grossman, Tucker, Perreault & Pfleger, PLLC

(57) ABSTRACT

A bonded structure for use in a garment, comprising at least two mutually interbonded interlining fabrics, wherein the interlining fabrics each include warp yarns and weft yarns and wherein the interlining fabrics are next to each other, such that the structure has high shape stability even after repeated washing and drying operations, wherein the warp yarns of the first interlining fabric are at least partly in a parallel arrangement with the warp yarns of a second interlining fabric, or in that part of the warp yarns of a first interlining fabric are oriented at an angle in the range from 45 ° to 90 ° in relation to the warp yarns of a second interlining fabric.

14 Claims, 3 Drawing Sheets

U.S. PATENT DOCUMENTS

| | | | | |
|---|---|---|---|---|
| 3,585,645 | A * | 6/1971 | Moriwaki | 2/272 |
| 4,415,622 | A * | 11/1983 | Kamat | 428/198 |
| 4,495,661 | A * | 1/1985 | Kamat | 2/97 |
| 4,814,225 | A * | 3/1989 | Kamat | 442/313 |
| 5,534,330 | A * | 7/1996 | Groshens | 428/198 |
| 6,242,372 | B1 | 6/2001 | Schwekutsh | |
| 6,300,413 | B1 * | 10/2001 | Simon et al. | 525/131 |
| 6,344,238 | B1 | 2/2002 | Schmitt et al. | |
| 6,461,462 | B1 * | 10/2002 | Judd et al. | 156/155 |
| 6,800,159 | B2 | 10/2004 | Itoh | |
| 6,986,935 | B2 * | 1/2006 | Kalbe et al. | 428/196 |
| 2002/0014300 | A1 | 2/2002 | Itoh | |
| 2008/0311809 | A1 | 12/2008 | Grynaeus et al. | |

FOREIGN PATENT DOCUMENTS

| | | |
|---|---|---|
| DE | 875032 | 4/1953 |
| DE | 2153859 | 5/1973 |
| DE | 8510513 | 5/1985 |
| DE | 19636722 | 3/1998 |
| DE | 19916628 | 10/2000 |
| DE | 102005006470 | 8/2006 |
| GB | 1395733 | 5/1975 |
| JP | 2000170018 | 6/2000 |

OTHER PUBLICATIONS

Bias Fabric defintion, "Textile Glossary" Celanese Acetate copyright 2001.*

Styrker, Marilyn "Selecting and Using Interfacing", Cooperative Extension Service, Kansas State University, May 1981.*

International Search Report and Written Opinion dated Jul. 18, 2008 issued in related International Patent Application No. PCT/EP2008/002444.

* cited by examiner

BONDED STRUCTURE FOR USE IN GARMENTS

FIELD OF THE INVENTION

The invention relates to a bonded structure for use in a garment, comprising at least two interbonded interlining fabrics, wherein the interlining fabrics each include warp yarns and weft yarns, and wherein the interlining fabrics are situated next to one another.

BACKGROUND

Garments that are worn for formal occasions may be rented as rental attire. Garments of this type are subjected to high material stresses on account of numerous care treatments. In particular, repeated final processing by dry cleaning results in high material stresses. As a result, after a short time these garments can no longer be worn at formal occasions because they have a used, worn-out appearance.

The referenced garments may be men's suits, which include pants, vests, sport coats, or blazers. Such garments may also be dress suits for women or girls.

For this reason, for several years there has been a need by ready-to-wear manufacturers and service providers in the rental attire industry for garments that withstand the stresses of commercial laundries under the conditions of DIN/ISO Standard "Commercial Laundering and Finishing Processes for Testing Work Clothes" (DIN ISO 15797:2004).

In order to withstand the treatment in commercial laundries with as little damage as possible, the garments must have very good washing resistance at temperatures of up to 95° C. The garments must also be able to withstand extreme drying conditions of up to 150° C. in a tunnel finisher under high numbers of operating cycles. Up to 50 cycles may be performed.

The garments known from the prior art are seldom, if ever, washable. At best, the known garments may be laundered at 30° C. in a gentle wash cycle in a home appliance, although loss of shape must be accepted. For this reason rental attire is usually dry cleaned, i.e., chemically cleaned, which is expensive, harmful to the environment, and effective only to a limited extent. In addition, complex drying and pressing operations are necessary to restore the shape of the garment. Furthermore, the known garments have only a limited lifetime, and their care is also very costly.

SUMMARY OF THE INVENTION

The above object is achieved with a bonded structure for use in a garment wherein at least part of the warp yarns of a first interlining fabric are oriented parallel to or form a right angle with the warp yarns of a second interlining fabric.

According to Claim 1, a bonded structure for use in a garment is characterized in that the warp yarns of a first interlining fabric are oriented parallel to the warp yarns of a second interlining fabric, at least in places.

According to Claim 2, a bonded structure for use in a garment is characterized in that the warp yarns of a first interlining fabric are oriented at an angle in the range of 45° to 90° in relation to the warp yarns of a second interlining fabric, at least in places.

According to the invention it has been found that the configurations of the warp yarns relative to one another according to the invention surprisingly achieve a bonded structure having high dimensional stability. In particular, it has been found that a very special effect is obtained, namely, a high washing resistance of the bonded structure up to 95° C. Furthermore, it has been found that the bonded structure or the garments provided with same have spray steam resistance up to 150° C. in all common cabinet and tunnel finishers. This applies for cycle times of at least 3 minutes. It has also been found that providing garments with such a bonded structure surprisingly allows these garments to be subjected to 20 or more treatment cycles according to DIN ISO 15797:2004. The bonded structure according to the invention allows the manufacture of garments which are offered as rental attire and which may be reused. The aforementioned object is achieved in this manner.

The first interlining fabric may be detached from the second interlining fabric after 50 care treatments of the bonded structure according to DIN ISO 15797:2004, using a force of at least 10 N/50 mm in a delamination test according to DIN EN ISO 54310. A bonded structure which maintains this strength after such stress from washing and care treatments in commercial laundries is particularly suited for use in garments in the rental attire industry.

At least one interlining fabric may have a plain weave or broken twill weave. This specific design allows a bonded structure to be easily manufactured from commercially available fabrics.

At least one interlining fabric may have a 1:3 broken twill weave, wherein one warp yarn in each case is alternatingly intertwined with three weft yarns and one weft yarn. Such an interlining fabric advantageously achieves a special cushioning characteristic of the bonded structure. Use of an interlining fabric having a 1:3 broken twill weave allows a floating, namely sliding, motion of the first interlining fabric relative to the second interlining fabric when the warp yarns of the first interlining fabric more preferably lie against the weft yarns of the second interlining fabric than on the warp yarns thereof.

At least one interlining fabric may have a 1:1 broken twill weave, wherein one warp yarn in each case is alternatingly intertwined with one weft yarn. Use of such an interlining fabric advantageously allows a combination with an additional interlining fabric having a 1:3 broken twill weave. A bonded structure of these two interlining fabrics allows a sliding bond of the interlining fabrics relative to another in places, thus providing a cushioning effect.

The warp yarns or weft yarns of a first interlining fabric may directly lie against the warp yarns or weft yarns of a second interlining fabric in places. This specific design allows a sliding bond of the first interlining fabric and the second interlining fabric, wherein the interlining fabrics are bonded to one another solely by an adhesive, in particular a hot-seal adhesive.

A thermofixable hot-seal adhesive may be applied in places on the warp yarns of at least one interlining fabric. Use of a thermofixable hot-seal adhesive allows thermal bonding of the interlining fabrics to one another. Specifically on this basis it is possible to use a hot-seal adhesive as described in DE 10 2005 006 470.1. Use of the referenced hot-seal adhesive has proven to be particularly advantageous in manufacturing a flat bonded structure. In particular, use of the referenced hot-seal adhesive achieves a bonded structure which provides a particular elastic or cushioning effect of the bonded structure by means of a memory effect. This memory effect ensures long-term dimensional stability of the bonded structure.

An adhesive based on polyolefin may be used as hot-seal adhesive. After hardening, such a hot-seal adhesive shows particularly good bonding with the interlining fabrics referenced herein. The type of polyolefins used is freely selectable in principle, provided that the MFI values referenced below are maintained. The hot-seal adhesive is preferably composed of two superposed grid-shaped layers having different compositions. Both layers are composed of hot-seal adhesive components which contain polyolefins and which are characterized by a selected melt flow index (MFI) value. The hot-seal adhesive component based on polyolefin and used to form the first layer preferably has an MFI value of 20 to 150, in particular 55 to 130, g/10 minutes (190° C./2.16 kg). The hot-seal adhesive component based on polyolefin and used to form the second layer preferably has an MFI value of 50 to 210 g/10 minutes, in particular 55 to 150 g/10 minutes (190° C./2.16 kg).

On this basis it is possible to apply the hot-seal adhesive in a pointwise manner in a pattern of 52 dots/cm$^2$. This pattern has proven to be particularly advantageous in ensuring both high dimensional stability and a good cushioning effect of the bonded structure.

The dots in the pattern may be composed of a first, paste-based layer, and a second, powder dot layer. The paste-based layer faces the interlining fabric to prevent the powder dot from penetrating too deeply into the interlining fabric when the dot melts. This is important in one process step in which an additional interlining fabric, under heat treatment, is pressed onto an interlining fabric on which the dots are applied.

The dots may have an average diameter of 0.3 to 0.5 mm. The selection of the average diameter in this range has proven to be advantageous, so that on the one hand hot-seal adhesive material is used sparingly, and on the other hand high strength of the bond of the interlining fabrics is ensured.

The interlining fabrics may form a laminate. Laminates exhibit a particularly reliable and secure bond of the interlining fabrics to one another. On this basis it is possible for the hot-seal adhesive used to have a melting point in the range of 127 to 195° C. The laminate may be manufactured by pressing the interlining fabrics together at a pressure of 20 to 45 newton/cm$^2$ at 127 to 195° C. over a fixing period of 15 to 25 seconds. A particularly stable laminate may be manufactured using these specific process steps.

Providing the bonded structure in the form of a laminate results in a cut-edge seal of the interlining fabrics. In this manner fraying and fiber migration are prevented. Both effects contribute greatly to quality of the garment in which the bonded structure is processed.

On this basis it is possible for a first interlining fabric having a 1:3 broken twill weave to lie against a second interlining fabric having a 1:1 broken twill weave, wherein the second interlining fabric is embedded in a sandwich-like manner between the first interlining fabric and a third interlining fabric. This specific design achieves a bonded structure which provides a particularly strong elastic force which has a shape-reinforcing effect on an outer fabric associated with a garment. The outer fabric rests on the first interlining fabric, with the third interlining fabric facing the body of the wearer of the garment. The body side of the bonded structure provides a particularly strong elastic force which has a shape-reinforcing effect on the outer fabric of the garment. This elastic force is advantageously so uniform that when the bonded structure is mechanically deformed, the elastic force restores the bonded structure to its original shape. This effect is referred to as a "memory effect." This effect subtly acts only unidirectionally, namely, toward the outer fabric. The back side of the bonded structure remains soft and supple, and is not uncomfortable for the wearer of the garment. The elastic force has a hard effect directed outwardly from the first interlining fabric, and has a soft effect directed inwardly in the direction of the second and third interlining fabrics. This is surprisingly achieved by the fact that the warp yarn side of the first interlining fabric on which three weft yarns are intertwined lies against the second interlining fabric, with the warp yarns of the first interlining fabric orthogonally oriented with respect to the warp yarns of the second interlining fabric. On this basis it is possible for the bonded structure to be used as a placket or sleeve head which is situated beneath the outer fabric.

The third interlining fabric may have a 1:3 broken twill weave, and together with the warp yarns may lie against the second interlining fabric. This specific design ensures a particularly strong elastic force which has a shape-reinforcing effect on the above-referenced outer fabric of the garment. This is surprisingly achieved by the fact that the warp yarn side of the third interlining fabric on which three weft yarns are intertwined lies against the second interlining fabric, with the warp yarns of the third interlining fabric orthogonally oriented with respect to the warp yarns of the second interlining fabric.

The third interlining fabric may be designed as a nonwoven fabric, and may lie against the second interlining fabric by means of a hot-seal adhesive layer. This design increases the wear comfort for the wearer of the garment, since a nonwoven fabric may have a particularly soft design.

The second interlining fabric may be designed as the outer fabric of a garment. In this manner a garment is produced which has high dimensional stability and/or an attractive appearance even after intensive washing and care treatment.

The bonded structure may have a weight per unit area of 20 to 500 g/m$^2$. This weight per unit area makes the bonded structure suitable for use in practically any garment.

The bonded structure described herein may be used as a placket. Such a placket may have a tape on the first interlining fabric which is attached to the bonded structure by use of the thermofixable hot-seal adhesive. The tape may preferably be made of a hydroentangled spun-bonded fabric. Compared to the tape materials otherwise used, this material ensures a permanently tear-resistant, stable, non-fraying bond with the placket, namely, the so-called "hinge effect." The tape is used to attach the placket to other sections of a sport coat, blazer, or jacket on which a placket is typically provided.

The interlining fabrics described herein may be composed of polyester yarns. This material has proven to be particularly suitable for providing the described cushioning characteristics of the bonded structure.

The interlining fabrics described herein may also be made of polyester yarns, polyamide yarns, and polyester-wool-goat's hair mixtures. These materials are common in the processing of garments and are easily workable.

The second interlining fabric may have polyester yarns as warp yarns, and wool or goat's hair in the weft, namely as weft yarns. Such a design of the second interlining fabric allows the bonded structure to be washed with practically no loss of shape.

The interlining fabrics described herein are preferably provided as thermofixable interlining fabrics. This allows the interlining fabrics to be laminated to one another, using a hot-seal adhesive.

The bonded structure described herein is suited according to the invention for provision in garments which must withstand the care treatments in commercial laundries. The referenced garments withstand the conditions of DIN/ISO Standard "Commercial Laundering and Finishing Processes for Testing Work Clothes" (DIN ISO 15797:2004).

The bonded structure described herein may be used in garments such as suits, ladies' dress suits, jackets, sport coats, blazers, Vestons, blouson jackets, coats, vests, pants, or skirts. All of the referenced garments may be offered to consumers as rental attire, using the bonded structure described herein.

The referenced garments may have outer fabrics which preferably contain mixtures of wool, polyester, or Lycra. The garments may also include linings which preferably are made of polyester. The garments may have collar felts, which are preferably mixtures of wool and polyester.

The bonded structures described herein may also be used for producing further elements for designing a garment. The bonded structure may be used for sleeve heads, shoulder pads, backing tape, seam reinforcement tape, undercollar materials, and similar components. Providing such elements for garments allows the garments to be used as rental attire. The referenced garments may also be used as business attire suitable for rental.

Several possibilities exist for advantageously providing and refining the teaching of the present invention. Reference is made to the subordinate claims and to the following explanation of preferred exemplary embodiments of the invention, with reference to the drawings.

In conjunction with the explanation of the preferred exemplary embodiments of the invention with reference to the drawings, generally preferred embodiments of the teaching are also explained.

DETAILED DESCRIPTION OF THE INVENTION

Figure 1:
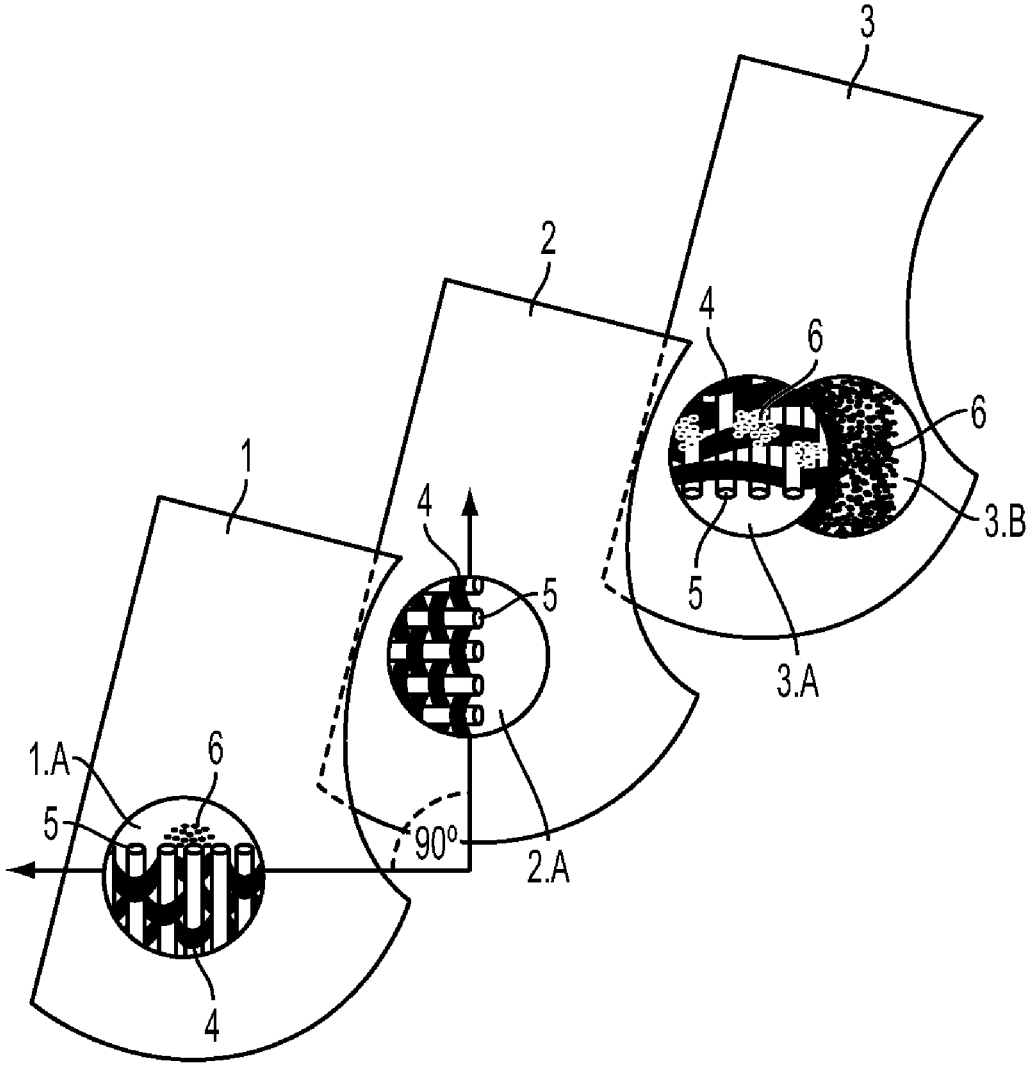
FIG. 1 shows a schematic illustration of the three interlining fabrics, which form a bonded structure.

FIG. 1 shows interlining fabrics 1, 2, 3 of a bonded structure for use as a placket in a garment. The bonded structure comprises at least two interbonded interlining fabrics 1, 2, 3. The interlining fabrics 1, 2, 3 each have warp yarns 4, denoted in black, and weft yarns 5, denoted in white. The interlining fabrics 1, 2, 3 are situated next to one another.

Interlining fabric 1 is composed of polyester yarns. According to detail 1.A, interlining fabric 1 has a 1:3 broken twill weave. One warp yarn 4 in each case is alternatingly intertwined with three weft yarns 5, denoted as black-white. A thermofixable hot-seal adhesive 6 is applied to the warp yarns 4 of the interlining fabric 1 in places. The side of the interlining fabric 1 which has the hot-seal adhesive 6 faces interlining fabric 2. According to detail 2.A, interlining fabric 2 has a 1:1 broken twill weave. One warp yarn 4 in each case is alternatingly intertwined with one weft yarn 5. The warp yarns 4 of the first interlining fabric 1 lie against the warp yarns 4 of the second interlining fabric 2. The warp yarn side of the interlining fabric 1, on which three weft yarns 5 are intertwined, lies against the interlining fabric 2 with a 1:1 broken twill weave.

Interlining fabric 3 has a 1:3 broken twill weave, as shown in detail 3.A. However, interlining fabric 3 may also be manufactured as a nonwoven fabric, as shown in detail 3.B. The side of interlining fabric 3 facing interlining fabric 2 likewise contains the thermofixable hot-seal adhesive 6. According to detail 3.B, the warp yarn side of interlining fabric 3 on which three weft yarns 5 are intertwined lies against interlining fabric 2 with a 1:1 broken twill weave.

The warp yarns 4 of interlining fabrics 1 and 3 define a right angle with respect to the warp yarns 4 of interlining fabric 2. This design results in the formation of high elastic force in the direction of interlining fabric 1.

The hot-seal adhesive 6 is applied in a pointwise manner to interlining fabrics 1 through 3 in a pattern of 52 dots/cm$^2$. Interlining fabrics 1, 2, 3 form a laminate, as shown in FIG. 2.

Figure 2:
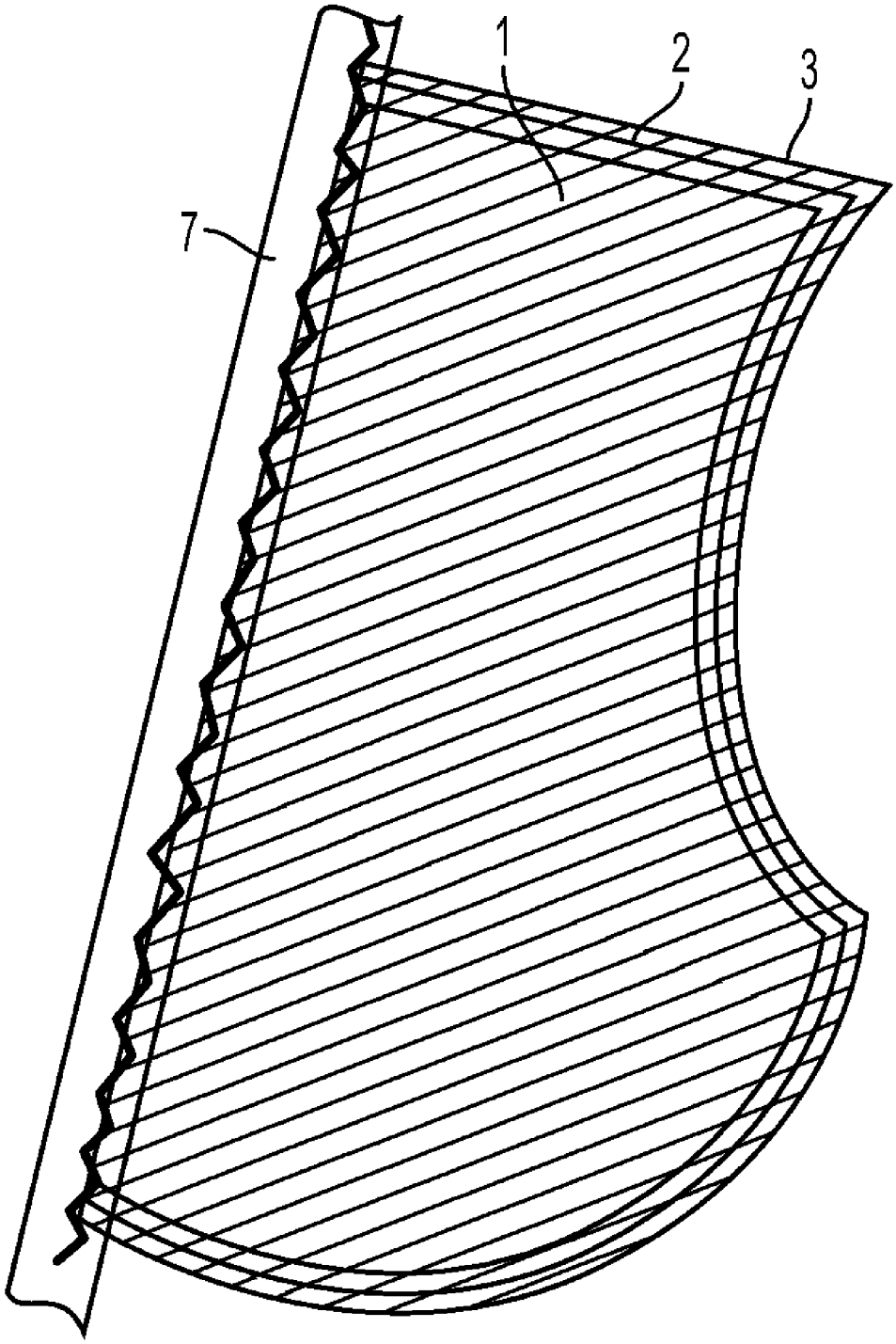
FIG. 2 shows a bonded structure composed of the three interlining fabrics according to FIG. 1, wherein a tape is provided on the first interlining fabric.

FIG. 2 further shows that a tape 7 is associated with interlining fabric 1. The tape 7 is made of a spun-bonded fabric. The spun-bonded fabric has a weight per unit area of 100 g/m$^2$. The bonded structure shown in FIG. 2 is used as a placket in a men's jacket 8. The bonded structure shown in FIG. 2 has a first interlining fabric 1 having a 1:3 broken twill weave which lies against a second interlining fabric 2 having a 1:1 broken twill weave. The second interlining fabric 2 is embedded in a sandwich-like manner between the first interlining fabric 1 and a third interlining fabric 3. The third interlining fabric 3 has a 1:3 broken twill weave, and with the warp yarns 4 lies against the second interlining fabric 2. Interlining fabrics 1 through 3 are bonded to one another by use of a hot-seal adhesive 6.

An adhesive based on polyolefin is used as hot-seal adhesive 6. The hot-seal adhesive is composed of two superposed grid-shaped layers having different compositions. Both layers are composed of hot-seal adhesive components which contain polyolefins and which are characterized by a selected melt flow index (MFI) value. The hot-seal adhesive component based on polyolefin and used to form the first layer has an MFI value of 20 to 150, in particular 55 to 130, g/10 minutes (190° C./2.16 kg). The hot-seal adhesive component based on polyolefin and used to form the second layer has an MFI value of 50 to 210 g/10 minutes, in particular 55 to 150 g/10 minutes (190° C./2.16 kg).

Figure 3:
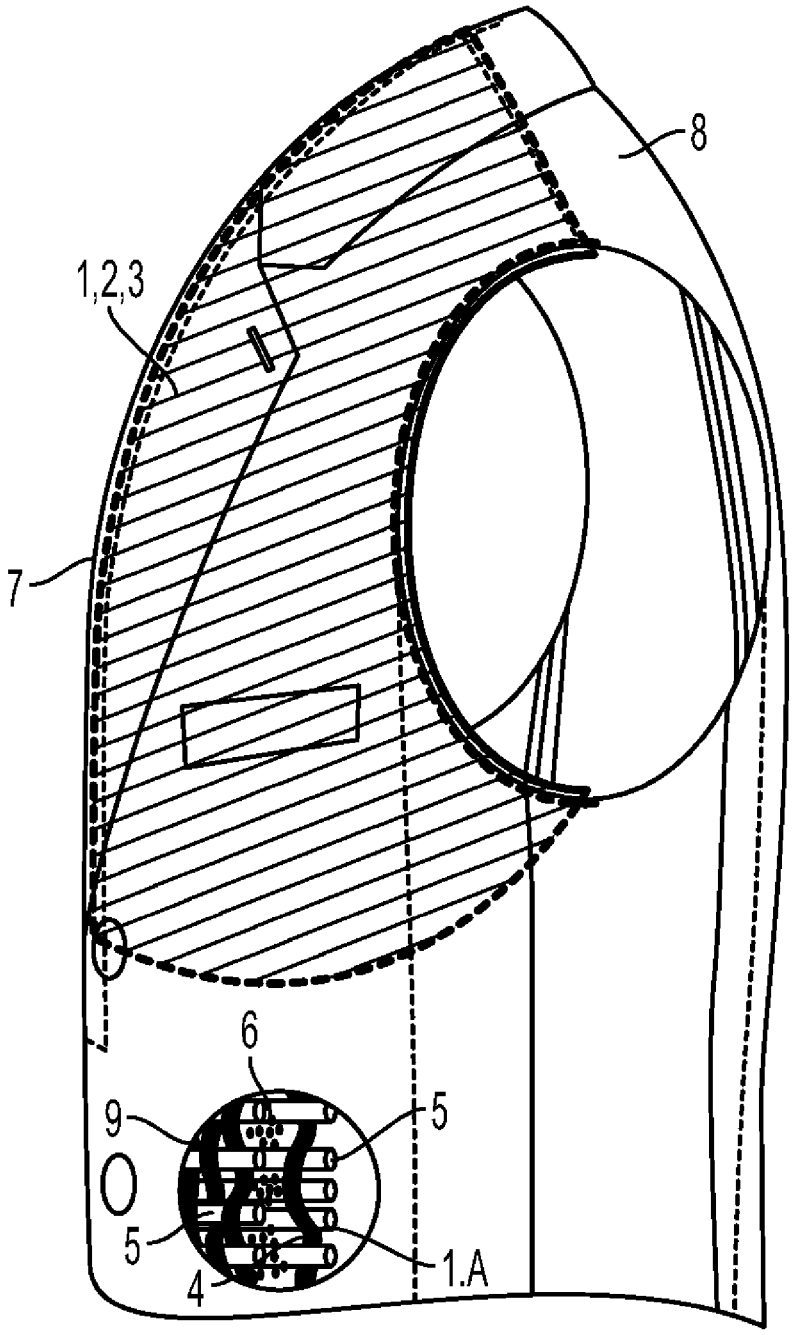
FIG. 3 shows a men's jacket in which the bonded structure according to FIG. 2 is used as a placket.

FIG. 3 shows a men's jacket 8 containing the bonded structure according to FIG. 2. The bonded structure according to FIG. 2 is sewn through the tape 7 made of spun-bonded fabric to the outer fabric of the men's jacket 8. The bonded structure according to FIG. 2 is also sewn to the men's jacket 8 in the arm and shoulder regions.

The men's jacket 8 shown in FIG. 3 also has an outer fabric 9 which is bonded to an interlining fabric 1*a*. The design of interlining fabric 1*a* corresponds to that of interlining fabric 1 of the bonded structure according to FIG. 2. Interlining fabric 1*a* is bonded to the outer fabric 9, using the above-referenced hot-seal adhesive 6. The warp yarn side of interlining fabric 1*a* on which three weft yarns 5 are intertwined lies against an outer fabric 9 having a 1:1 broken twill weave. The warp yarns 4 of interlining fabric 1*a* are oriented parallel to the warp yarns 4 of the outer fabric 9. In this manner high dimensional stability is imparted to the outer fabric 9, even after multiple care treatments.

With regard to further advantageous embodiments and refinements of the teaching according to the invention, reference is made to the general portion of the description section, and to the claims.

Lastly, it is noted with particular emphasis that the above exemplary embodiments, selected in a purely arbitrary manner, are used solely for explaining the teaching according to the invention, but do not limit said teaching to these exemplary embodiments.

What is claimed is:

1. A bonded structure for use in a garment, comprising at least two mutually interbonded interlining fabrics, wherein the interlining fabrics each include warp yarns and weft yarns and wherein the interlining fabrics are situated next to one another, characterized in that the warp yarns of a first interlining fabric are oriented parallel to the warp yarns of a second interlining fabric or in that the warp yarns of a first interlining fabric are oriented at an angle in the range of 45° to 90° in relation to the warp yarns of a second interlining fabric, at least in places, wherein the force for detaching the first interlining fabric from the second interlining fabric after 50 care treatments of the bonded structure according to DIN ISO 15797:2004 is at least 10 N/50 mm and wherein the warp yarns or the weft yarns of a first interlining fabric lie against the warp yarns or the weft yarns of a second interlining fabric with inclusion of an adhesive comprising first and second superposed grid-shaped layers of different composition and each layer including a polyolefin.

2. The bonded structure according to claim 1, wherein at least one interlining fabric has a plain weave or broken twill weave.

3. The bonded structure according to claim 1, wherein at least one interlining fabric has a 1:3 broken twill weave, wherein one warp yarn in each case is alternatingly intertwined with three weft yarns and one weft yarn.

4. The bonded structure according to claim 1, wherein at least one interlining fabric has a 1:1 broken twill weave, wherein one warp yarn in each case is alternatingly intertwined with one weft yarn.

5. The bonded structure according to claim 1, wherein said adhesive comprises a thermofixable hot-seal adhesive which is applied in places on the warp yarns of at least one interlining fabric.

6. The bonded structure according to claim 5, wherein the hot-seal adhesive is applied in a point wise manner in a pattern of 52 dots/$cm^2$.

7. The bonded structure according to claim 6, wherein the dots have an average diameter of 0.3 to 0.5 mm.

8. The bonded structure according to claim 1, wherein the interlining fabrics form a laminate.

9. The bonded structure according to claim 1, wherein a first interlining fabric having a 1:3 broken twill weave lies against a second interlining fabric having a 1:1 broken twill weave, wherein the second interlining fabric is embedded in a sandwich-like manner between the first interlining fabric and a third interlining fabric.

10. The bonded structure according to claim 9, wherein the third interlining fabric has a 1:3 broken twill weave, and the warp yarns lies against the second interlining fabric.

11. The bonded structure according to claim 9, wherein the third interlining fabric is designed as a nonwoven fabric and lies against the second interlining fabric with inclusion of a hot-seal adhesive layer.

12. The bonded structure according to claim 1, wherein the second interlining fabric is designed as the outer fabric of a garment.

13. The bonded structure according to claim 1, characterized by a weight per unit area of 20 to 500 g/$m^2$.

14. The bonded structure according to claim 1, wherein said bonded structure is in the form of a placket.

* * * * *